US009067146B1

(12) United States Patent
Cordray

(10) Patent No.: US 9,067,146 B1
(45) Date of Patent: Jun. 30, 2015

(54) SWING

(71) Applicant: Gregory Cordray, Akron, OH (US)

(72) Inventor: Gregory Cordray, Akron, OH (US)

(73) Assignee: Quality Innovative Products, LLC, Akron, OH (US)

( * ) Notice: Subject to any disclaimer, the term of this patent is extended or adjusted under 35 U.S.C. 154(b) by 0 days.

(21) Appl. No.: 13/909,072

(22) Filed: Jun. 3, 2013

Related U.S. Application Data

(63) Continuation-in-part of application No. 12/850,696, filed on Aug. 5, 2010, now Pat. No. 8,454,450.

(60) Provisional application No. 61/273,492, filed on Aug. 5, 2009.

(51) Int. Cl.
*A63G 9/12* (2006.01)
*A63G 9/00* (2006.01)
*A47D 1/10* (2006.01)

(52) U.S. Cl.
CPC ..... *A63G 9/00* (2013.01)

(58) Field of Classification Search
CPC ..... A63G 9/00; A63G 9/02; A63G 9/12; A63G 9/14; A47D 13/105; A47D 13/107; A47D 1/00; A47D 1/10
USPC ..... 472/118–125; 297/273, 274
See application file for complete search history.

(56) References Cited

U.S. PATENT DOCUMENTS

| | | | | |
|---|---|---|---|---|
| 2,701,604 | A | | 2/1955 | St. Louis |
| 3,130,969 | A | | 4/1964 | Groth |
| 3,145,990 | A | | 8/1964 | Prouty |
| 3,261,607 | A | | 7/1966 | Horowitz et al. |
| 3,937,463 | A | | 2/1976 | Soisson |
| 4,014,540 | A | | 3/1977 | Caulkins |
| 4,978,120 | A | | 12/1990 | Greenwood |
| 5,067,706 | A | | 11/1991 | Tsai |
| 5,149,117 | A | | 9/1992 | Wilkens, Sr. et al. |
| 5,342,245 | A | | 8/1994 | Webb, Jr. |
| 5,427,575 | A | * | 6/1995 | Berk ..... 472/118 |
| 5,887,944 | A | | 3/1999 | Boost |
| 5,997,403 | A | | 12/1999 | Fonti |
| 6,572,483 | B1 | | 6/2003 | Hoffman |
| 6,702,686 | B1 | | 3/2004 | Brown |
| 7,175,535 | B1 | | 2/2007 | Marmentini |
| 7,300,355 | B1 | | 11/2007 | Hense |
| 2005/0107173 | A1 | | 5/2005 | Pelletier |

* cited by examiner

*Primary Examiner* — Kien Nguyen
(74) *Attorney, Agent, or Firm* — Fay Sharpe LLP

(57) ABSTRACT

A swing includes a body with a concave central portion defining a recessed concave seat and a peripheral edge surrounding the concave central portion. The peripheral edge includes a plurality of tether openings, each of which is adapted to receive an associated tether. A top wall extends radially outward from the recessed concave seat. An outer wall is connected to and projects downwardly from an outer end of said top wall. A peripheral groove is defined adjacent the top wall and the outer wall, wherein said plurality of tether openings each open through the top wall and into the peripheral groove. A tether system is adapted to suspend the body from an associated support member, the tether system engaged with the tether openings and at least part of said tether system located in said peripheral groove. The peripheral edge of the body can be circular, a non-rectangular polygon, or an oval or other non-circular curved shape.

18 Claims, 16 Drawing Sheets

SWING

CROSS-REFERENCE TO RELATED APPLICATION

This application is a continuation-in-part of application U.S. Ser. No. 12/850,696 filed Aug. 5, 2010, now assigned U.S. Pat. No. 8,454,450, which claims priority from and benefit of the filing date of U.S. provisional patent application Ser. No. 61/273,492 filed Aug. 5, 2009, and the entire disclosure of each of said prior applications is hereby expressly incorporated by reference into the present specification.

BACKGROUND

There are generally two types of swings that are known for use with swing sets or with other playground installations and/or is a residential setting: (i) conventional rectangular rigid swing seats or flexible strap-like swing seats meant to move on an arc in a back-and-forth motion; or (ii) tire swings that use a vehicle tire or like structure and that can twist and swing in any direction such as diagonal, circular, etc. These prior swings require the child or other user to pump his or her legs or otherwise shift their weight to move the swing, and require the user to maintain a sitting position and hold onto the swing or the rope(s) or chain(s) by which the swing is suspended. As such, these known swings have been found to have limited entertainment and enjoyment for certain children and other users that are not capable of maintaining the proper position on the swing and/or that are not capable of controlling the motion of the swing in the manner intended and required.

Furthermore, these prior swings and others have been found to be deficient for a wide variety of other reasons including ease of manufacture, ease of installation, ease of use, durability, variety of modes of operation, safety, and other such attributes. As such, a need has been found for a new and improved swing.

SUMMARY

In accordance with a first aspect of the present development, a swing includes a body including a concave central portion defining a recessed seat and a peripheral edge surrounding the concave central portion. The peripheral edge includes a plurality of tether openings, and a tether system includes a plurality of tether portions respectively engaged with said plurality of tether openings.

In accordance with another aspect of the present development, a swing includes a body with a concave central portion defining a recessed concave seat and a peripheral edge surrounding the concave central portion. The peripheral edge includes a plurality of tether openings, each of which is adapted to receive an associated tether. A top wall extends radially outward from the recessed concave seat. An outer wall is connected to and projects downwardly from an outer end of said top wall. A peripheral groove is defined adjacent the top wall and the outer wall, wherein said plurality of tether openings each open through the top wall and into the peripheral groove. A tether system is adapted to suspend the body from an associated support member, the tether system engaged with the tether openings and at least part of said tether system located in said peripheral groove.

In accordance with another aspect of the present development, the peripheral edge of said body is oval in shape.

In accordance with a further aspect of the present development, the peripheral edge of said body is a non-rectangular polygon such as a pentagon, hexagon, octagon or other non-rectangular polygonal shape.

In accordance with another aspect of the present development, the peripheral edge includes at least four of the tether openings arranged symmetrically about the peripheral edge such that the four tether openings are circumferentially spaced at 90 degree intervals from each other and such that each of the four tether openings are diametrically opposed from another one of the four tether openings.

In accordance with a further aspect of the present development, the seat includes a drain opening defined therein.

In accordance with an additional aspect of the present development, the drain opening is centrally located in the seat so as to be equidistant from each of the four tether openings.

In accordance with one aspect of the present development, the body is defined as a one-piece molded polymeric construction.

In accordance with another aspect of the present development, the body is defined from multiple interconnected body member sections.

In accordance with another aspect of the present development, an upper surface of said seat is smooth and a lower surface of the seat comprises a plurality of ribs extending therefrom.

In accordance with one aspect of the present development, the ribs comprise a plurality of radial ribs, each of which extends radially outward from an inner end located adjacent the drain opening.

In accordance with another aspect of the present development, each of the radial ribs is oriented normal to said lower surface of said seat.

In accordance with a further aspect of the present development, the peripheral edge comprises a top wall that extends radially outward from the seat, an outer circular wall connected to and projecting downwardly from an outer end of the top wall, and an inner circular wall connected to and projecting downwardly from an inner end of the top wall such that the inner circular wall is located radially inward from and is arranged concentrically with the outer circular wall and a peripheral groove is defined between the inner and outer circular walls, wherein the tether openings are defined in the top wall and open through the top wall into the peripheral groove.

In accordance with another aspect of the present development, a plurality of peripheral edge support ribs each extend between and interconnect the inner and outer circular walls.

In accordance with one aspect of the present development, the peripheral groove includes first and second open regions that are free of said peripheral edge support ribs, wherein the first open region is located between first and second ones of the tether openings, and wherein the second open region is located between third and fourth ones of the tether openings.

In accordance with another aspect of the present development, the swing further comprises a tether system including a lower portion including a plurality of flexible tethers engaged with the tether openings and an upper portion including one or more flexible tethers adapted to suspend the swing from a support member.

In one embodiment, the recessed central seat portion comprises fabric or another flexible material.

In accordance with another embodiment, the body includes a ballast chamber including a ballast material therein.

DETAILED DESCRIPTION

Figure 1A:
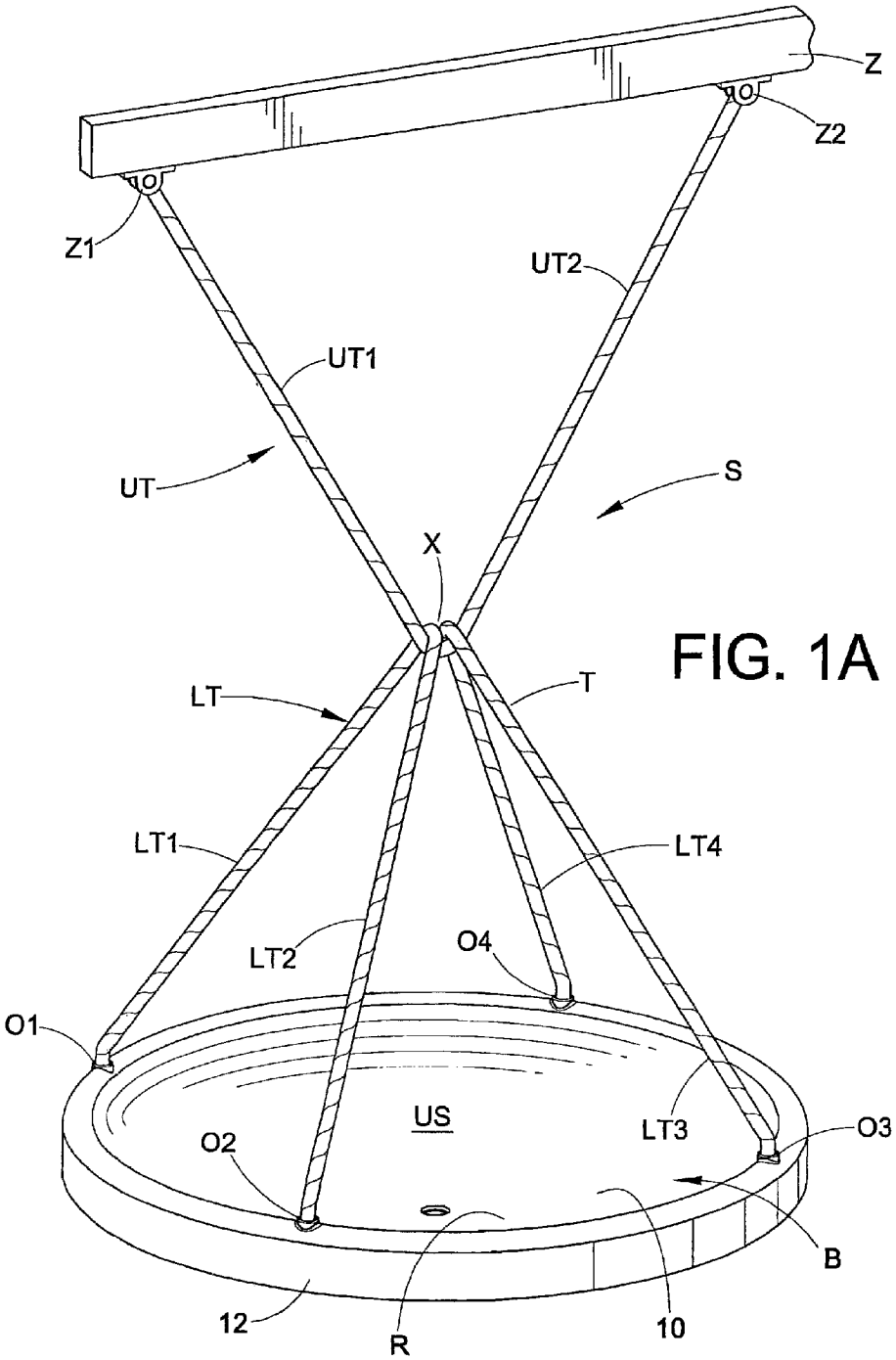
FIG. 1A shows a swing system in accordance with the present development, wherein the tether system thereof is arranged in a first configuration.

FIG. 1A shows a swing system S in accordance with the present development. The swing system S includes a swing body B and a tether system T that is adapted to suspend the swing body from a support structure Z such that the swing body B is free to swing in any direction including back-and-forth, sideways, diagonal, circular, etc. and such that the swing body can twist. As shown, the tether system T includes an upper portion UT comprising two upper tethers UT1,UT2 and a lower portion LT comprising at least four lower tethers LT1,LT2,LT3,LT4. The lower tethers LT1-LT4 can be defined from a single length or multiple separate lengths of rope or chain or other flexible member(s), and the upper tethers UT1, UT2 can likewise be defined from a single length or two separate lengths of rope or chain or other flexible member(s). FIG. 1A shows an arrangement in which the respect lower ends of the lower tethers LT1-LT4 are each connected to the swing body B, and the upper ends of the lower tethers LT1-LT4 converge to and are joined at an apex X such that the lower tethers LT1-LT4 define a cone shape. The lower ends of the upper tethers UT1,UT2 are each connected to the upper ends of the lower tethers LT1-LT4 at the apex X, and the upper ends of the upper tethers UT1,UT2 are adapted to be connected to the support structure Z at respective locations Z1,Z2 that are spaced-apart from each other. In an alternative embodiment, the tether system T includes only one of the upper tethers UT1 or UT2 that extends between the apex X and a single connecting location on the support structure Z.

Figure 1B:
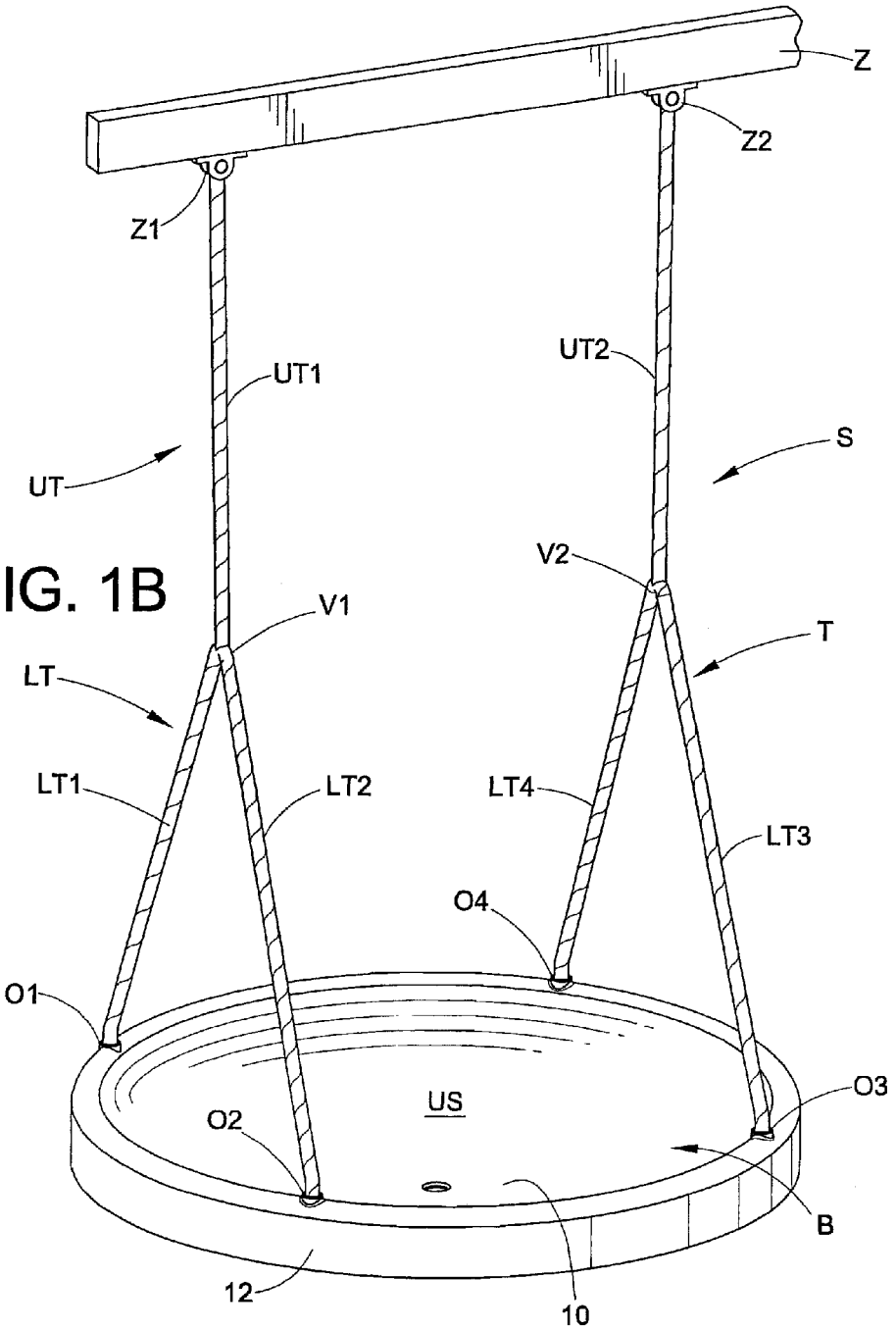
FIG. 1B shows a swing system in accordance with the present development, wherein the tether system thereof is arranged in a second configuration.
Figure 2:
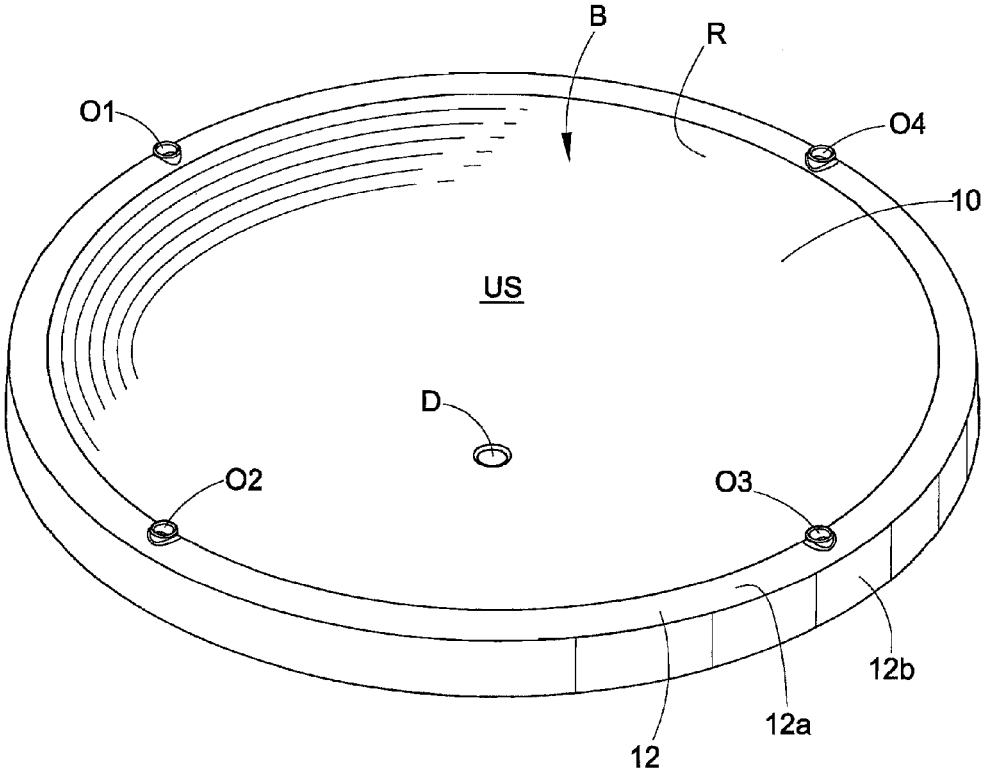
FIG. 2 is an isometric view of a swing body of the swing system of FIGS. 1A and 1B.
Figure 3:
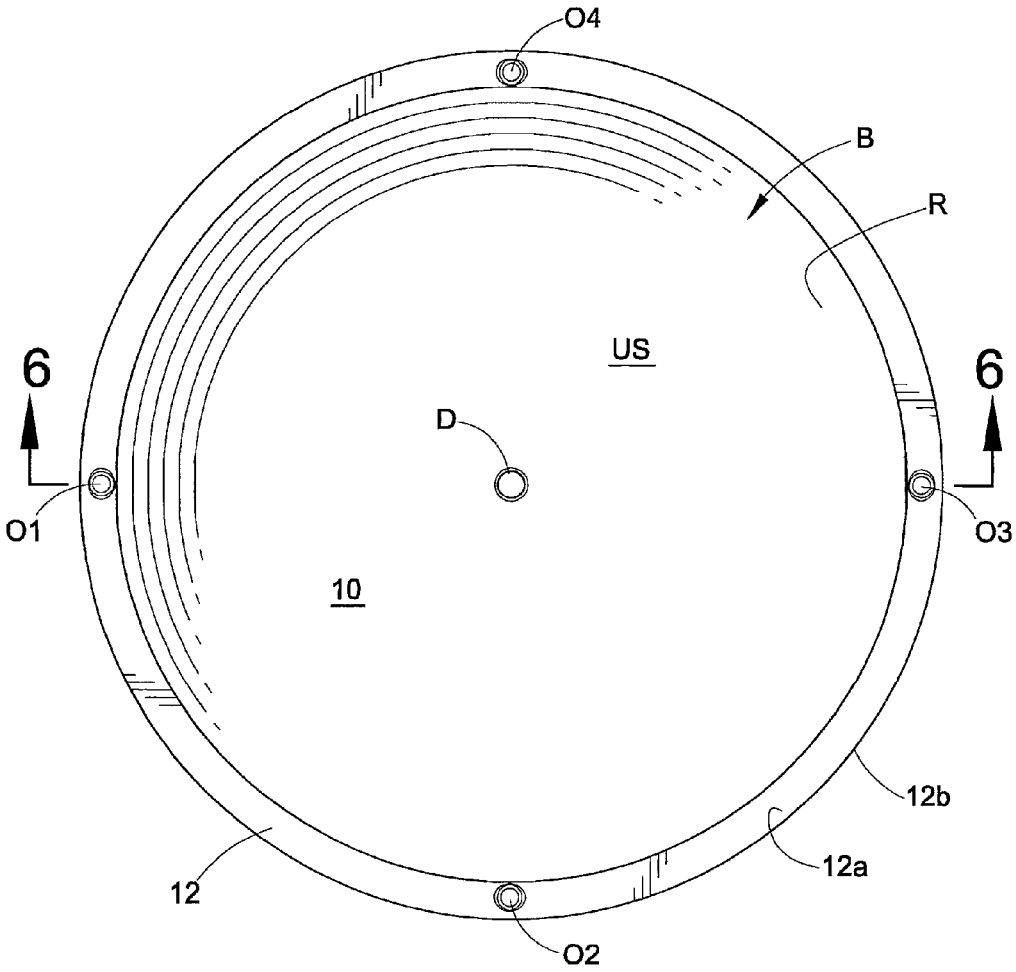
FIG. 3 is a top view of the swing body of FIG. 2.
Figure 4:
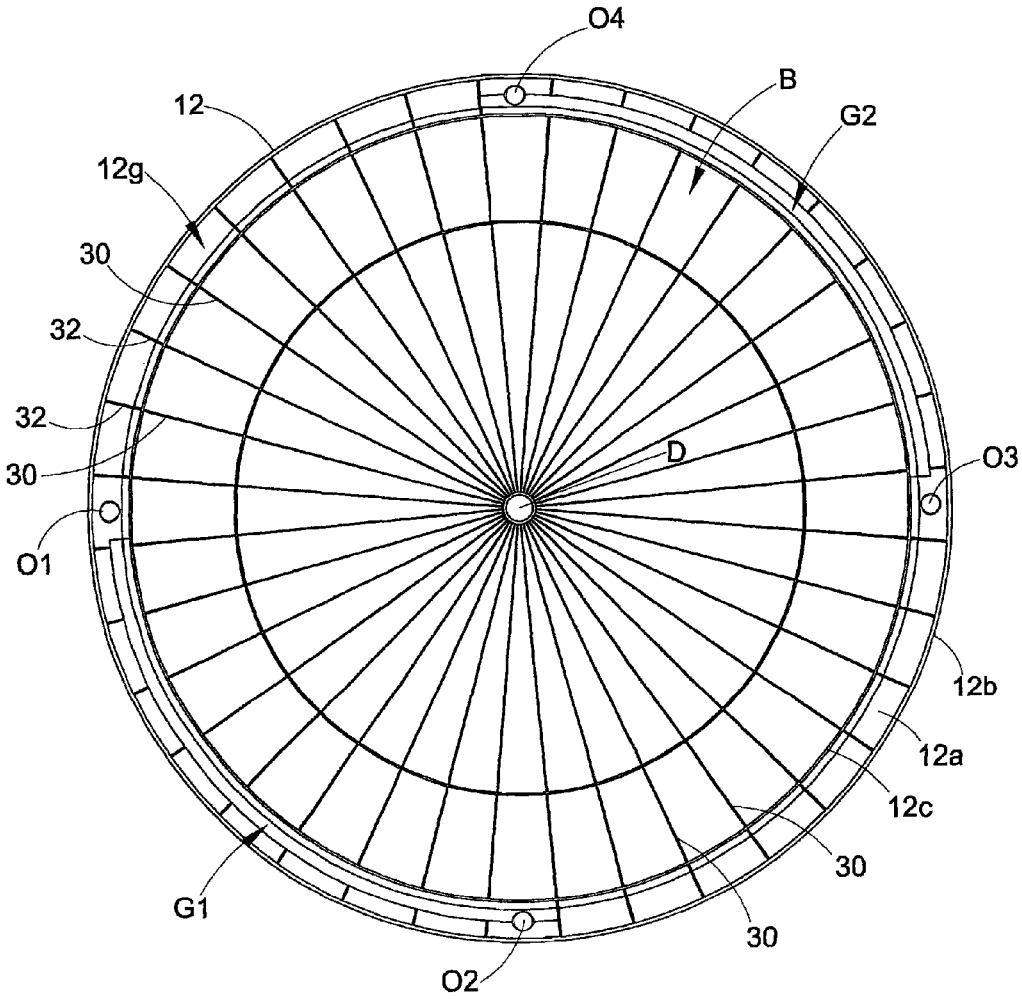
FIG. 4 is a bottom view of the swing body of FIG. 2.
Figure 5:
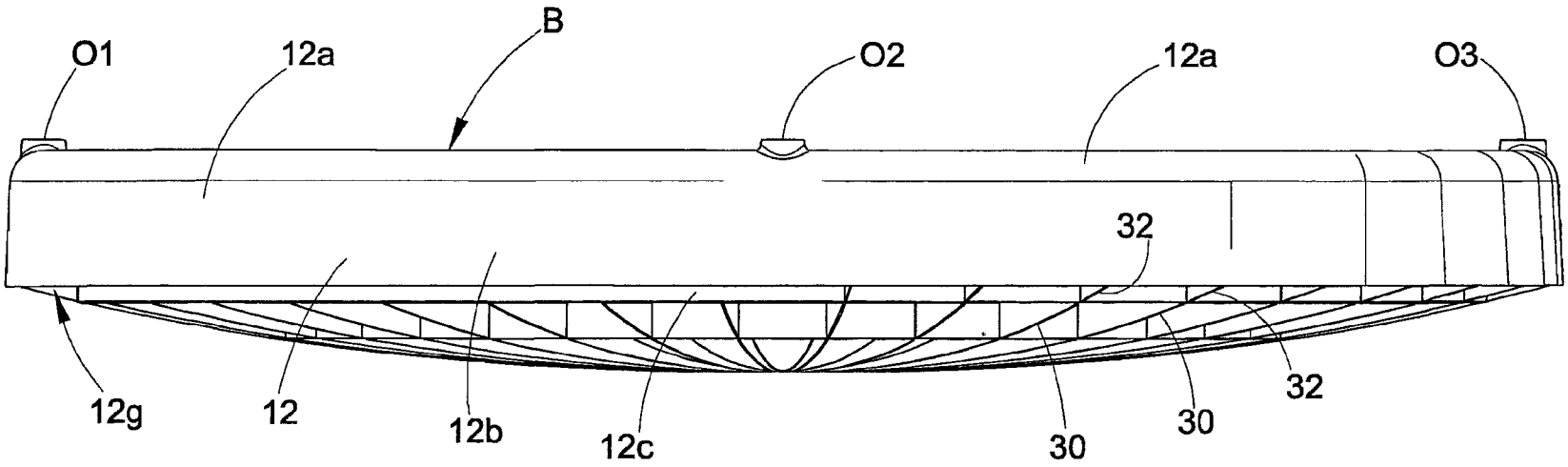
FIG. 5 is a side view of the swing body of FIG. 2.
Figure 6:
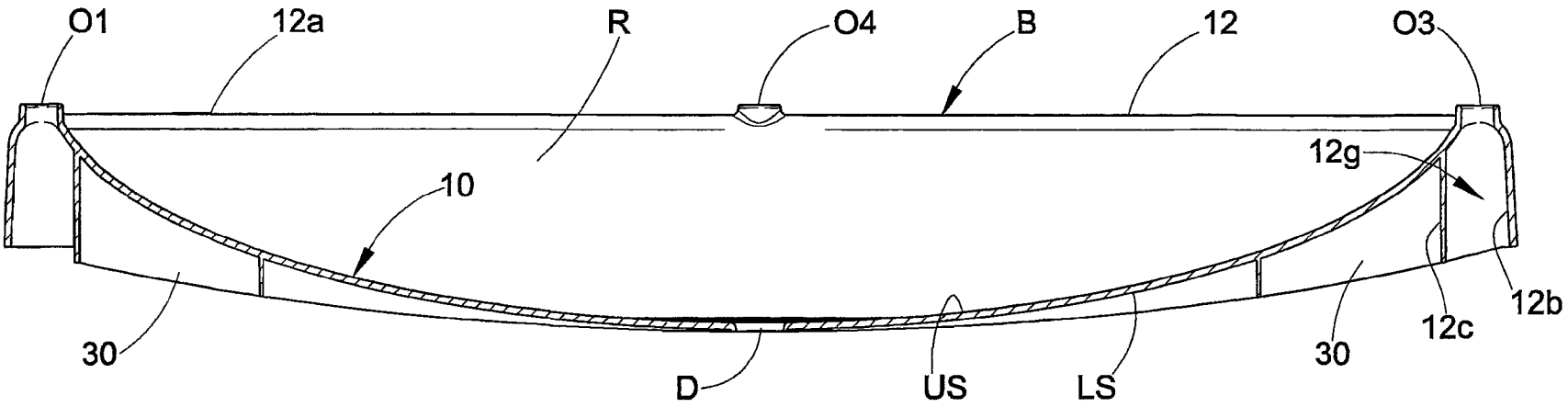
FIG. 6 is a section view taken at line 6-6 of FIG. 3.

FIG. 1B shows another alternative arrangement for the tether system T in which the upper ends of the first and second lower tethers LT1,LT2 are joined at a first vertex V1 such that a first triangle is defined by the first and second lower tethers LT1,LT2, and the upper ends of the third and fourth lower tethers LT3,LT4 are joined at a second vertex V2 such that a second triangle is defined by the third and fourth lower tethers LT3,LT4. In this case, the first and second upper tethers UT1, UT2 are connected respectively to the first and second vertices V1,V2. In such an arrangement, the swing system S is configured to swing predominantly in a back-and-forth manner with the upper tethers UT1,UT2 moving in respective planes that are vertical or inclined.

FIGS. 2-6 show different views of the swing body B, itself. The body B is defined as a one-piece molded polymeric construction from any suitable polymer resin material, although other materials such as metal, wood, etc. can be used instead. The swing body B includes a concave central seat portion 10 defining recess R that forms a seat and a peripheral edge 12 surrounding the concave central portion 10. The seat defined by the concave central seat portion 10 is adapted to support an infant or a small child or can be dimensioned to support an adult. In one embodiment, the peripheral edge 12 of the body is circular such that the body defines a saucer or disk. In one embodiment, the body has a diameter in the range of 22 inches to 30 inches, and the recess has a maximum depth relative to the peripheral edge 12 in the range of 2.5 inches to 4 inches.

The peripheral edge 12 of the body B includes a plurality of tether openings O1, O2, O3, O4 with which the lower tethers LT1-LT4 are respectively engaged. In the illustrated embodiment, the peripheral edge 12 comprises at least four of the tether openings O1-O4 arranged symmetrically about the peripheral edge 12 such that the four tether openings O1-O4 are circumferentially spaced at 90 degree intervals from each other and such that each of said four tether openings are diametrically opposed from another one of the four tether openings.

The concave central seat portion 10 includes a drain opening D defined therein for allowing water and dirt/sand to flow by gravity from the seat recess R through the drain opening D. The drain opening D is centrally located in the central seat portion 10 so as to be equidistant from each of said four tether openings O1-O4 and so as to be located at the deepest part of the recess R.

An upper surface US of the concave central seat portion 10 is smooth for maximum comfort and to facilitate flow or water and sand toward the drain opening D. The opposite lower surface LS of the concave central seat portion 10 comprises a plurality of seat support ribs 30 extending or projecting therefrom, or the ribs 30 can be omitted. In the illustrated embodiment, the seat support ribs 30 are radial ribs, each of which extends radially outward from an inner end located adjacent the drain opening D to an outer end located adjacent the peripheral edge 12. Each of the seat support radial ribs 30 is oriented normal to said lower surface LS.

The peripheral edge 12 comprises: (i) a top wall 12*a* that extends radially outward from the outermost edge of the seat recess R; (ii) an outer circular wall 12*b* connected to and projecting downwardly from an outer end of the top wall 12*a*; and, (iii) an inner circular wall 12*c* connected to and projecting downwardly from an inner end of the top wall 12*a* such that the inner circular wall 12*c* is located radially inward from and is arranged concentrically with the outer circular wall 12*b*. As such, a peripheral groove 12*g* is defined between the outer and inner circular walls 12*b*,12*c*. The tether openings O1-O4 are each defined in the top wall 12*a* and each open through the top wall 12*a* into the peripheral groove 12*g*.

The body B can further comprise a plurality of optional peripheral edge support ribs 32 that each extend between and interconnect the outer and inner circular walls 12*b*,12*c* to provide support and strength to the outer and inner circular walls 12*b*,12*c*. The peripheral edge support ribs 32 are aligned respectively with the seat support ribs 30, such that each peripheral edge support rib 32 extends in a radial direction coincident with the seat support rib 30 with which it is aligned. The peripheral groove 12*g* comprises first and second open regions G1, G2 that extend circumferentially and that are free of the peripheral edge support ribs 32. The first open region G1 is located between the first and second tether openings O1,O2, and the second open region G2 is located between the third and fourth tether openings O3,O4. The first open region G1 is adapted to receive the rope or chain or other member that defines the first and second lower tethers LT1, LT2 and allows the rope/chain/member thereof to extend circumferentially in the peripheral groove 12*g* between and through the tether openings O1,O2 in the case where the first and second lower tethers are defined from a single rope/chain/member. The second open region G2 is adapted to receive the rope or chain or other member that defines the third and fourth lower tethers LT3, LT4 and allows the rope/chain/member thereof to extend circumferentially in the peripheral groove 12*g* between and through the tether openings O3,O4 in the case where the third and fourth lower tethers are defined from a single rope/chain/member.

Figure 7:
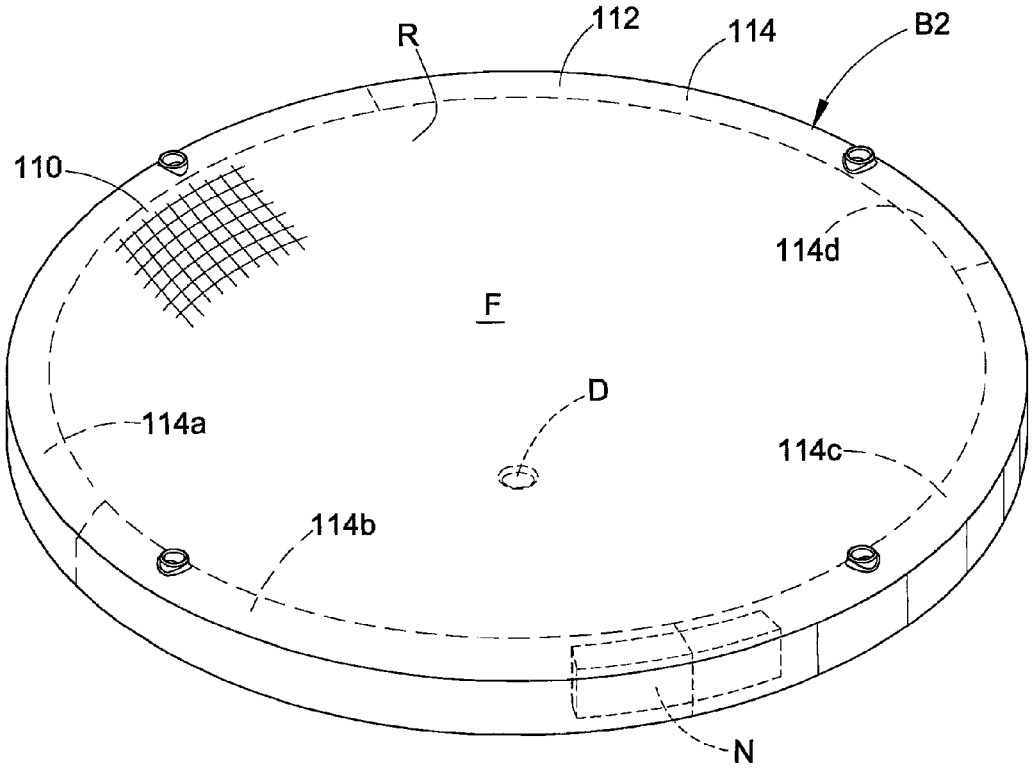
FIG. 7 shows an alternative swing body wherein the peripheral edge is defined by a one-piece or multi-piece annular ring and the recessed seat comprises a flexible fabric or other material connected to the peripheral edge.

FIG. 7 shows an alternative swing body B2 wherein the peripheral edge 112 is defined by a one-piece or multi-piece annular ring 114 (the ring sections of the optional multi-piece structure are indicated by broken lines at 114*a*,114*b*,114*c*, 114*d*) and wherein the recessed central seat portion 110 comprises a flexible fabric or other material F connected to the peripheral edge 112. In the case where the annular ring 114 is defined as a multi-piece structure, the ring sections 114*a*, 114*b*,114*c*,114*d* are connected using a suitable mechanical connection that can also include use of the lower tethers LT1-LT4 to secure each ring section 114*a*,114*b*,114*c*,114*d* to its adjacent connected ring section. In one embodiment, a connector N is inserted into and frictionally engaged with the respective open ends of adjacent ring sections 114*a*,114*b*, 114*c*,114*d* to join adjacent ring sections as shown in FIG. 7. In one embodiment, the fabric or other material F is pervious to water and sand so the drain opening D is not included, but it can be included if desired and/or if the fabric or other material F is impervious to water and sand as shown in broken lines.

Figure 8:
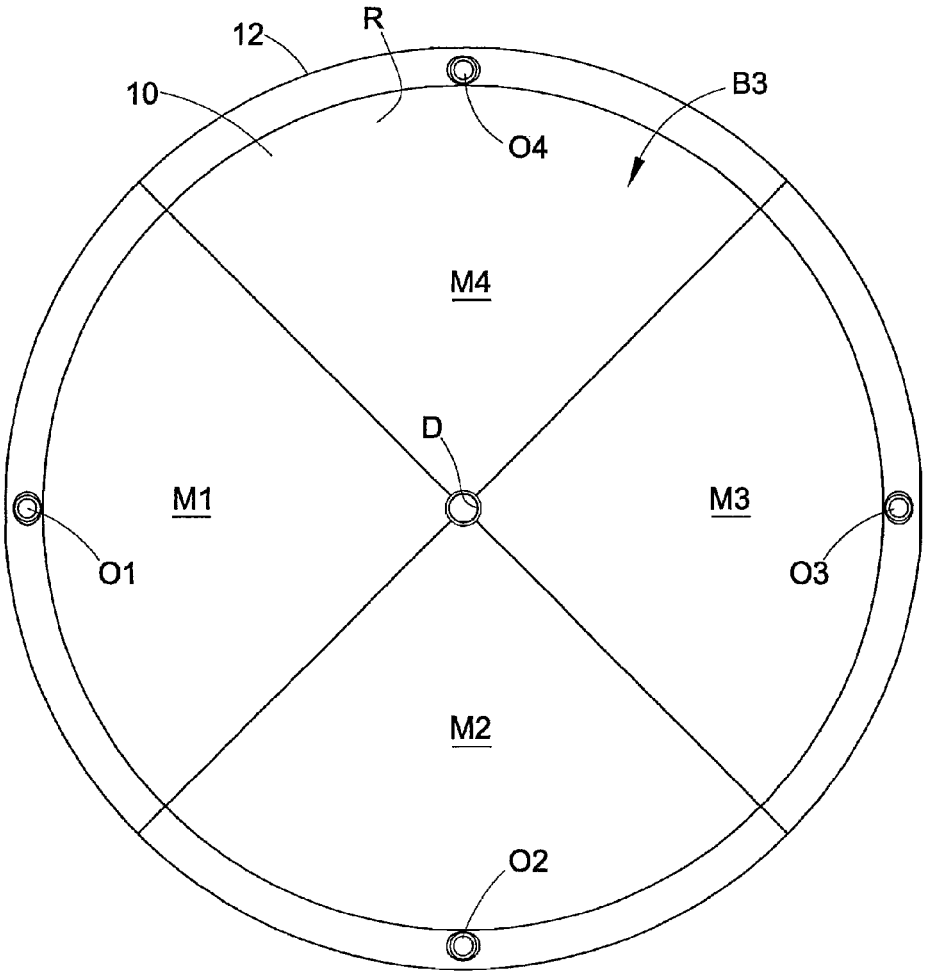
FIG. 8 shows another alternative embodiment, wherein the swing body is defined from multiple separate body members that are interconnected to construct the body.

FIG. 8 shows another alternative embodiment, wherein a swing body B3 is defined from multiple separate molded polymeric body member sections M1,M2,M3,M4 that are interconnected using a suitable mechanical connection to construct the body B3, which is otherwise identical to the body B. The body member sections M1,M2,M3,M4 are preferably each identical to each other. Here, again, the lower tethers LT1-LT4 can be used to connect adjacent connected body member sections together.

Figure 9:
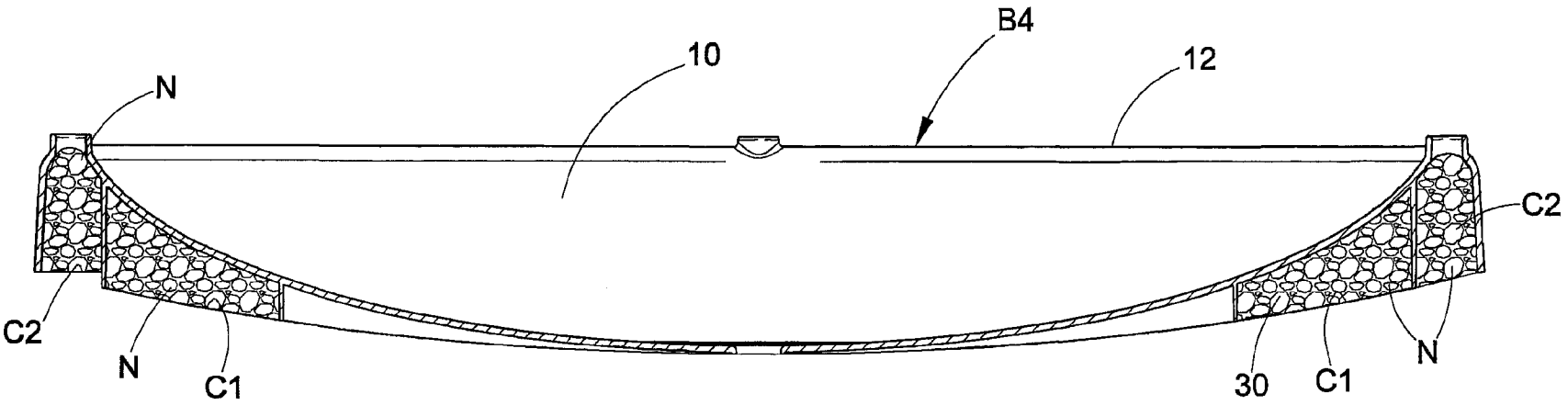
FIG. 9 shows another alternative embodiment in which a swing body includes one or more optional ballast chambers that include and/or are adapted to receive and retain a ballast material.

FIG. 9 shows another alternative embodiment in which a swing body B4 is otherwise identical to the body B but includes one or more ballast chambers M1,M2 that include and/or are adapted to receive and retain a ballast material N such as sand, water, metal weights, rocks, or any other suitable ballast material to improve the swinging performance of the swing. The ballast chamber(s) M1,M2 can be located beneath the concave central seat portion (e.g., chamber M1) and/or within the peripheral edge 12 (e.g., chamber M2). The ballast material N can permanently installed in the chambers M1,M2 or is selectively inserted into and removable from the chambers M1,M2.

Figure 10:
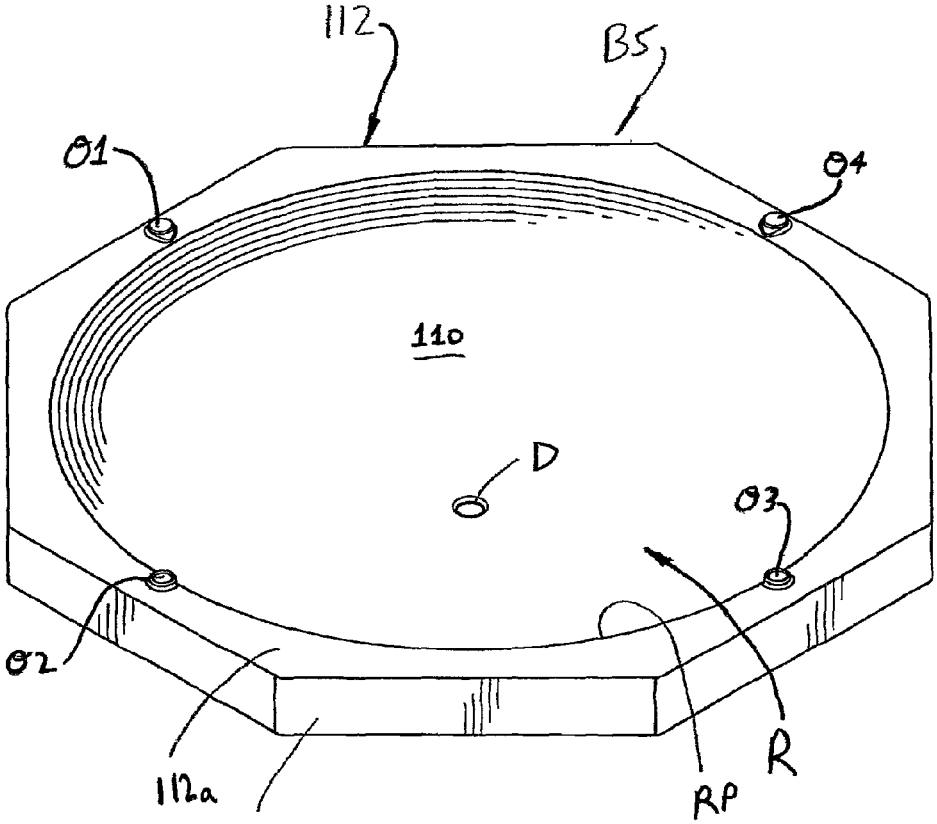
FIGS. 10 and 11 are isometric and top plan views of an alternative swing body B5 that comprises a non-rectangular polygonal peripheral edge, in which the recessed seat includes a circular peripheral or outer edge.
Figure 10A:
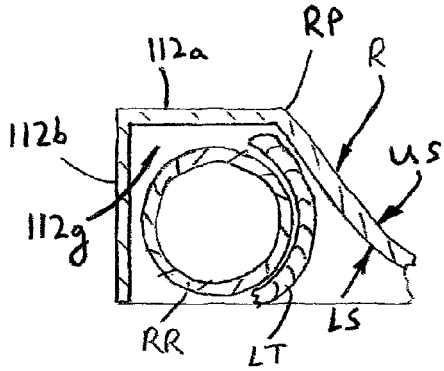
FIG. 10A is a partial section view of the swing body of FIG. 10 showing an optional reinforcement ring.
Figure 11:
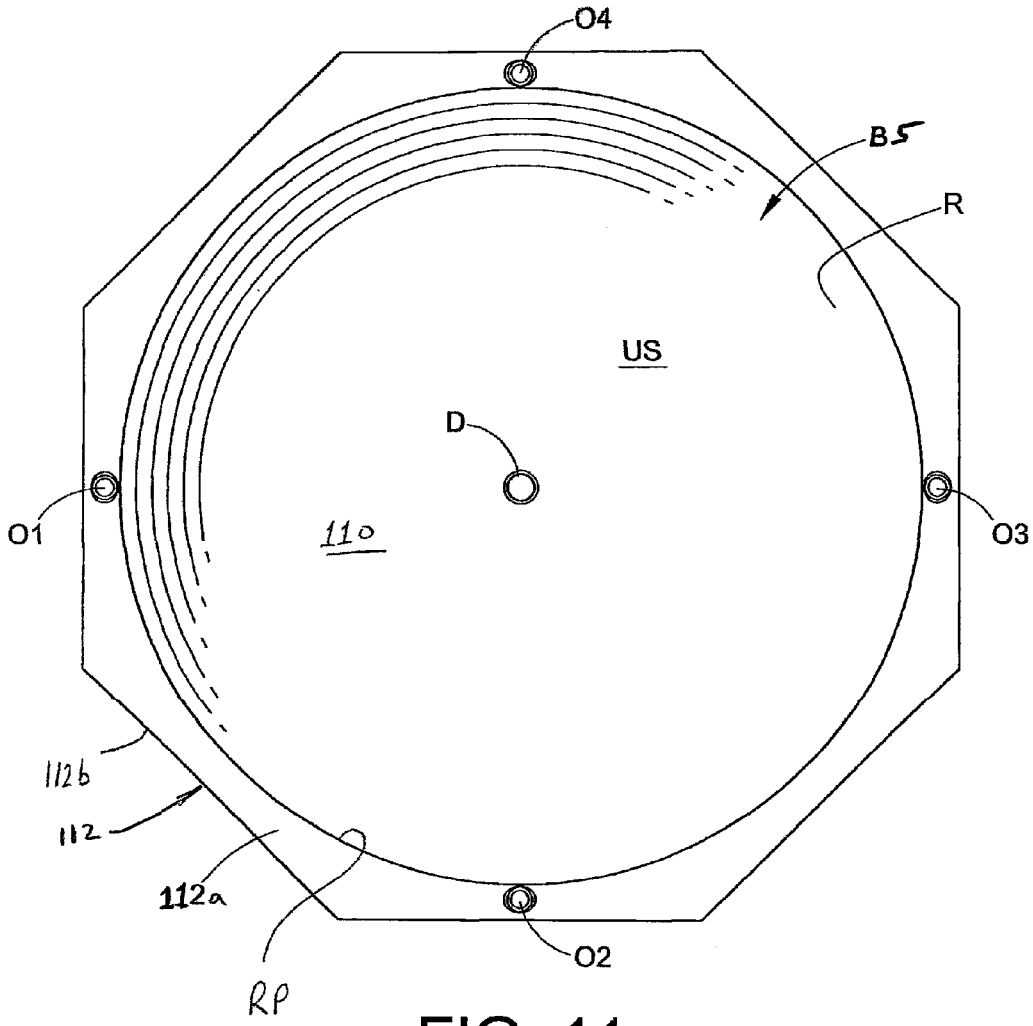

FIGS. 10 and 11 are isometric and top plan views of an alternative swing body B5 adapted for being suspended by the tether system T. Except as otherwise shown and/or described herein, the body B5 is identical to the body B described above, and like features relative to the body B are identified with like reference numbers that are 100 greater than those used in connection with the body B. The body B5 is preferably defined as a one-piece polymeric construction but is can be provided by a multi-piece assembly of polymeric and other materials. Instead of a circular peripheral wall 12 as used for the body B, the body B5 comprises a non-rectangular polygonal peripheral edge 112. As shown, the peripheral edge 112 is an octagon with 8 equal length linear sides, but the peripheral edge 112 can be defined with any other non-rectangular polygon shape using linear sides that are equal in length or unequal in length relative to each other. For example, the peripheral edge can define a trapezoid, pentagon, hexagon, octagon or other non-rectangular polygon shape. More particularly, the peripheral edge 112 comprises: (i) a top wall 112*a* that extends radially outward from the outermost or upper peripheral edge or lip RP of the seat recess R; and, (ii) an outer non-rectangular polygonal peripheral wall 112*b* connected to and projecting downwardly from an outer end of the top wall 112*a*. As shown in the section view of FIG. 10A, a peripheral groove 112*g* is defined under the top wall 112*a* adjacent the outer wall 112*b*, between the top wall 112*a*, the outer wall 112*b*, and the lower surface LS of the seat portion 110. The tether openings O1-O4 are each defined in the top wall 112*a* and each open through the top wall 112*a* into the peripheral groove 112*g*. A reinforcement ring RR defined from metal, fiber glass, wood, a polymeric material or other material is optionally located in the groove 112*g* to stiffen and strengthen the body B5, and the lower tethers LT1-LT4 (indicated generally at LT in FIG. 10A) are preferably wrapped and/or otherwise engaged with the reinforcement ring RR if the reinforcement ring is present in the groove 112*g*. In FIG. 10A, the reinforcement ring RR is shown as a tubular structure such as a metal tube. The swing body B5 is constructed such that the outer/upper peripheral edge or lip RP of the seat recess R is circular, where the seat recess R joins with the top wall 112*a*. The reinforcement ring RR can be circular as shown or can be otherwise shaped to fit in the groove 112*g*, e.g., defined in a non-rectangular polygonal shape that corresponds with the non-rectangular polygonal shape of the body peripheral wall 112*b*.

Figure 12:
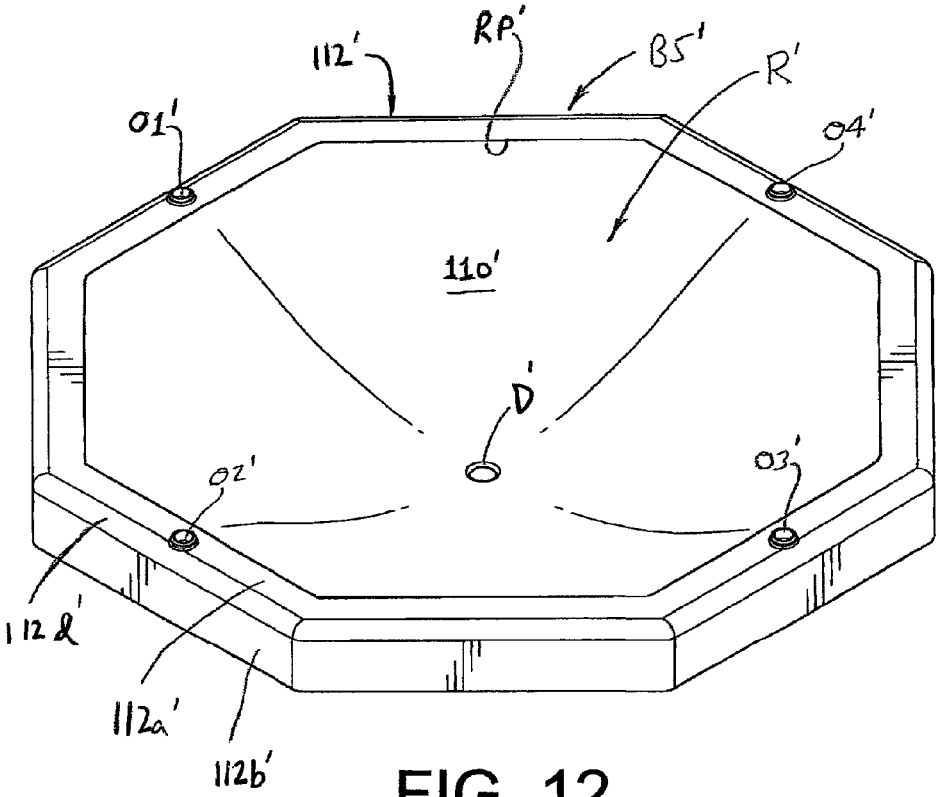
FIGS. 12 and 13 are respectively similar to FIGS. 10 and 11, but show another alternative embodiment of a swing body B6 including a non-rectangular peripheral edge, in which the recessed seat also includes a peripheral/outer edge that has a non-rectangular polygonal shape that matches the non-rectangular shape of the peripheral edge of the swing body.
Figure 13:
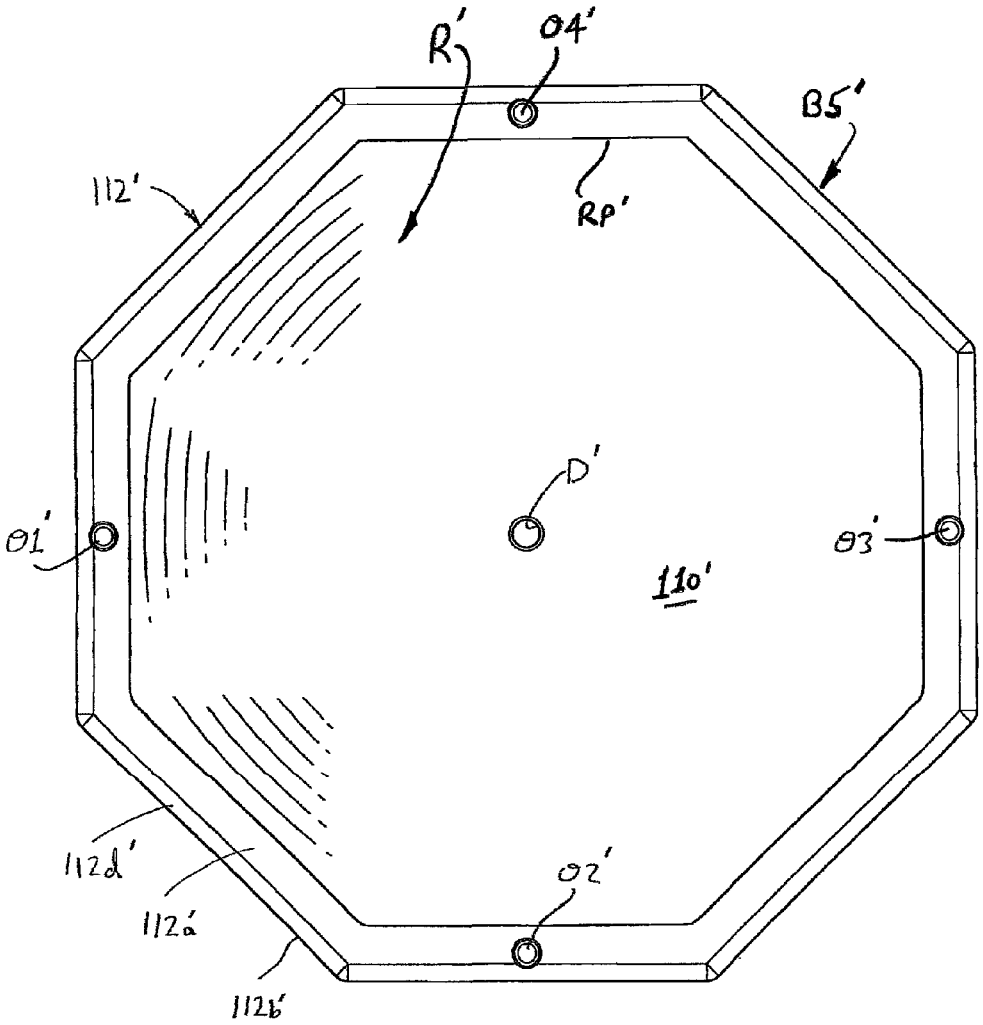

FIGS. 12 and 13 are isometric and top plan views of an alternative swing body B5' that is identical to the swing body B5 except as otherwise shown and/or described herein. Like components relative to the swing body B5 are identified with like reference numbers including a primed (') designation. With respect to the swing body B5', the outer or upper peripheral edge or lip RP' of the seat recess R' is defined to have a non-rectangular polygonal shape that corresponds to the non-rectangular polygonal shape of the peripheral wall 112*b*'. Also, the swing body B5' includes a beveled or rounded transition wall 112*d*' that joins the top wall 112*a*' of the peripheral edge 112' to the outer wall 112*b*', and this transition wall 112*d*' provides added comfort to a user when moving onto and off of the recess R of the seat portion 110'.

Figure 14:
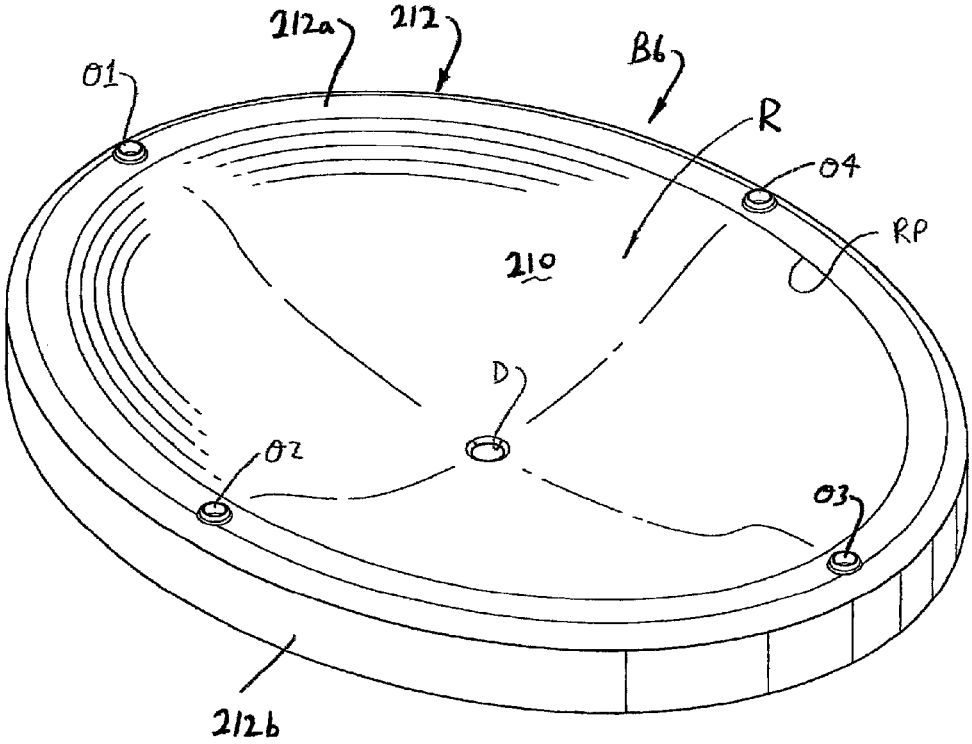
FIGS. 14 and 15 are isometric and top plan views that show another alternative embodiment of a swing body B7 formed in accordance with the present development, in which the swing body comprises an oval peripheral edge and in which the recessed seat is correspondingly ovalized so that the peripheral or outer edge of the recessed seat is shaped to correspond with the oval peripheral edge of the swing body.
Figure 14A:
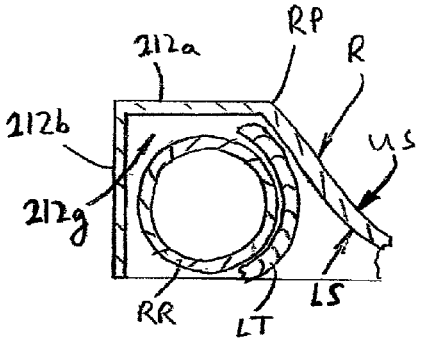
FIG. 14A is a partial section view of the swing body of FIG. 14 showing an optional reinforcement ring.
Figure 15:
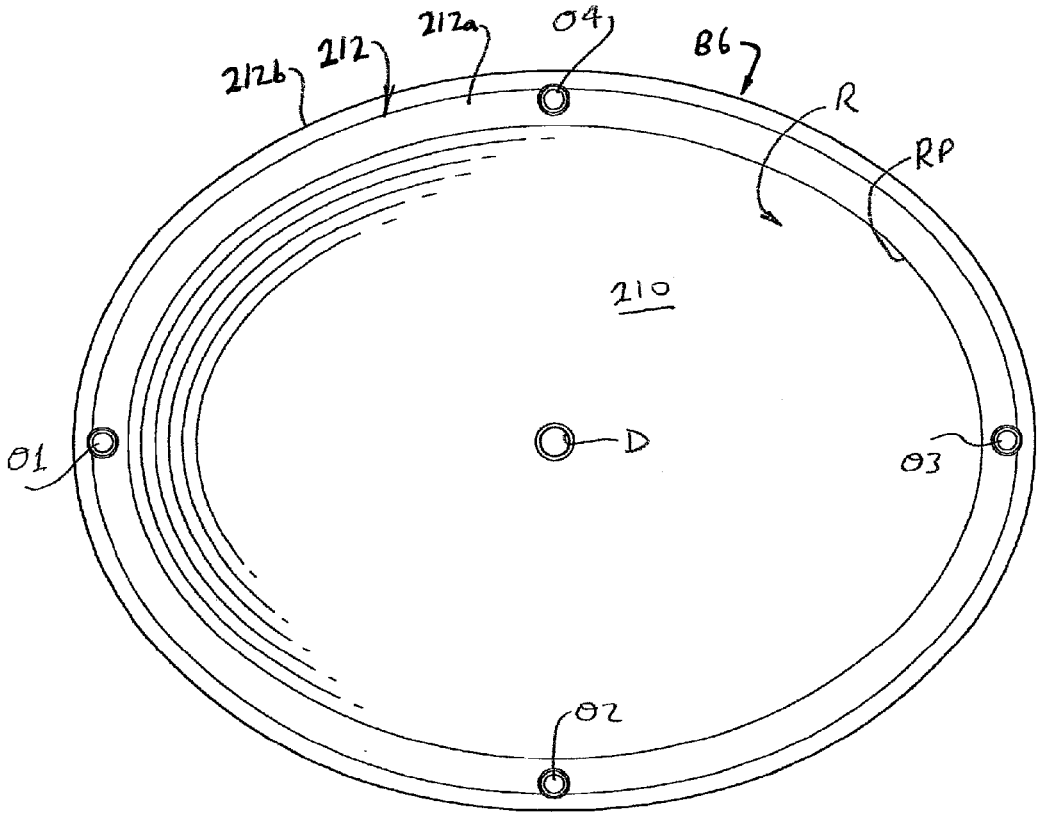

FIGS. 14 and 15 illustrate another alternative embodiment of a swing body B6 formed in accordance with the present development and adapted for being suspended by the tether system T. Except as otherwise shown and/or described herein, the body B6 is identical to the body B described above, and like features relative to the body B are identified with like reference numbers that are 200 greater than those used in connection with the body B. The body B6 is defined as a one-piece molded polymeric construction or is assembled from separate polymeric and/or other structures. Instead of a circular peripheral wall 12 as used for the body B, the body B6 comprises a non-circular curved peripheral wall 212. As shown, the peripheral wall 212 defines an oval, but the peripheral wall 212 can be defined with any other non-circular curved shape. More particularly, the peripheral wall 212 comprises: (i) a top wall 212*a* that extends radially outward from the outermost or upper peripheral edge or lip RP of the seat recess R; and, (ii) an outer oval or otherwise non-circular curved peripheral wall 212*b* connected to and projecting downwardly from an outer end of the top wall 212*a*. As shown in the section view of FIG. 14A, a peripheral groove 212*g* is defined under the top wall 212*a* adjacent the outer wall 212*b*, between the top wall 212*a*, the outer wall 212*b*, and the lower surface LS of the seat portion 210. The tether openings O1-O4 are each defined in the top wall 212*a* and each open through the top wall 212*a* into the peripheral groove 212*g*. A reinforcement ring RR defined from metal, fiber glass, wood, a polymeric material or other material is optionally located in the groove 212*g* to stiffen and strengthen the body B5, and the lower tethers LT1-LT4 (indicated generally at LT in FIG. 14A) are preferably wrapped and/or otherwise engaged with the reinforcement ring RR if the reinforcement ring is present in the groove 212*g*. In FIG. 14A, the reinforcement ring RR is shown as a tubular structure such as a metal tube. The swing body B6 is constructed such that the outer/upper peripheral edge or lip RP of the seat recess R is defined to match or correspond to the shape of the outer peripheral wall 212*b*, i.e., the outer/upper peripheral edge or lip RP of the recess R is defined to be oval in the illustrated embodiment. The reinforcement ring RR also defines a shape so that it fits in the groove 212*g* and, as such, the reinforcement ring RR is oval shaped in the illustrated embodiment.

The development has been described with reference to preferred embodiments. Those of ordinary skill in the art will recognize that modifications and alterations to the preferred embodiments are possible. The disclosed preferred embodiments are not intended to limit the scope of the following claims, which are to be construed as broadly as possible, whether literally or according to the doctrine of equivalents.

The invention claimed is:

1. A swing comprising:

a body including a concave central portion defining a recessed seat and a peripheral edge surrounding the concave central portion;

said peripheral edge comprising a plurality of tether openings;

a tether system comprising a plurality of tether portions respectively engaged with said plurality of tether openings;

wherein said peripheral edge comprises:

a top wall that extends radially outward from an upper lip of said recessed seat;

an outer wall connected to and projecting downwardly from an outer end of said top wall;

a peripheral groove defined adjacent the top wall and the outer wall;

wherein said tether openings are defined in said top wall and open through said top wall into said peripheral groove.

2. The swing as set forth in claim 1, wherein said seat includes a drain opening defined therein.

3. The swing as set forth in claim 2, wherein said drain opening is centrally located in said seat and is equidistant from each of said tether openings.

4. The swing as set forth in claim 1, wherein said body is defined as a one-piece molded polymeric construction.

5. The swing as set forth in claim 1, wherein said outer wall defines a circular shape.

6. The swing as set forth in claim 1, wherein said outer wall defines a non-rectangular polygon shape.

7. The swing as set forth in claim 6, wherein said outer wall defines one of a pentagon, a hexagon, and an octagon shape.

8. The swing as set forth in claim 6, wherein said upper lip of said recessed seat is circular.

9. The swing as set forth in claim 6, wherein said upper lip of said recessed seat is defined as a non-rectangular polygon that corresponds in shape to said outer wall.

10. The swing as set forth in claim 6, further comprising a reinforcing ring located in said peripheral groove.

11. The swing as set forth in claim 10, wherein said tether portions are engaged with said reinforcing ring.

12. The swing as set forth in claim 1, wherein said outer wall defines a non-circular curved shape.

13. The swing as set forth in claim 12, wherein said outer wall defines an oval shape.

14. The swing as set forth in claim 12, wherein said upper lip defines a non-circular curved shape that corresponds to said non-circular curved shape of said outer wall.

15. The swing as set forth in claim 14, further comprising a reinforcing ring located in said peripheral groove.

16. The swing as set forth in claim 15, wherein said tether portions are engaged with said reinforcing ring.

17. The swing as set forth in claim 1, wherein said concave central portion defining said recessed seat comprises a flexible material connected to said peripheral edge.

18. A swing comprising:

a body including a concave central portion defining a recessed concave seat and a peripheral edge surrounding the concave central portion;

said peripheral edge comprising:

a plurality of tether openings, each of said tether openings adapted to receive an associated tether;

a top wall that extends radially outward from said recessed concave seat;

an outer wall connected to and projecting downwardly from an outer end of said top wall;

a peripheral groove defined adjacent said top wall and said outer wall, wherein said plurality of tether openings each open through said top wall and into said peripheral groove; and, a tether system adapted to suspend the body from an associated support member, said tether system engaged with said tether openings and at least part of said tether system located in said peripheral groove.

* * * * *